US006517322B2

(12) United States Patent
Fiebing et al.

(10) Patent No.: US 6,517,322 B2
(45) Date of Patent: Feb. 11, 2003

(54) HYDROSTATIC VARIABLE DISPLACEMENT PUMP HAVING A COMPACT HOUSING TO FACILITATE SWASH PLATE INSTALLATION

(75) Inventors: Carsten Fiebing, Jevenstedt (DE); Reinhardt Thoms, Neumunster (DE)

(73) Assignee: Sauer-Danfoss, Inc., Ames, IA (US)

( * ) Notice: Subject to any disclaimer, the term of this patent is extended or adjusted under 35 U.S.C. 154(b) by 64 days.

(21) Appl. No.: 09/901,510

(22) Filed: Jul. 9, 2001

(65) Prior Publication Data

US 2002/0015643 A1 Feb. 7, 2002

(30) Foreign Application Priority Data

Aug. 1, 2000 (DE) ..... 100 37 481

(51) Int. Cl.[7] ..... F04B 1/26; F04B 1/12; F01B 1/00

(52) U.S. Cl. ..... 417/222.1; 417/269; 92/12.2; 91/473

(58) Field of Search ..... 417/222.1, 222.2, 417/269; 92/13, 71, 12.2; 91/473; 384/537

(56) References Cited

U.S. PATENT DOCUMENTS 4,797,069 A * 1/1989 Hartley et al. ..... 417/222.1
5,803,714 A * 9/1998 Tominaga et al. ..... 417/269
5,842,343 A * 12/1998 Frey ..... 60/486
6,092,457 A * 7/2000 Inoue et al. ..... 92/129

* cited by examiner

*Primary Examiner*—Charles G. Freay
*Assistant Examiner*—Michael K. Gray

(57) ABSTRACT

A hydrostatic variable displacement pump of swash plate construction has a cylinder block 2, in a housing 1, with displacement pistons 3 guided therein, a swash plate 4 and at least a first bearing 5 and a second bearing 6, which supports the angle adjustable swash plate 4. The housing 1 has a first opening, through which the swash plate can be introduced. The first bearing 5 has a removable outer race 13 which is designed such that, following installation of the second bearing 6 of the swash plate 4 in the bearing seat 8, it fixes said swash plate in the bearing seat 7 of the first bearing 5. The servomechanism 9, 10 is integrated in a cover 10 which closes off the housing 1 on the side of the first bearing 5.

9 Claims, 5 Drawing Sheets

HYDROSTATIC VARIABLE DISPLACEMENT PUMP HAVING A COMPACT HOUSING TO FACILITATE SWASH PLATE INSTALLATION

FIELD OF THE INVENTION

The invention relates to a hydrostatic variable displacement pump of swash plate construction which allows easier installation while using a compact housing.

BACKGROUND OF THE INVENTION

Hydrostatic, closed-circuit variable displacement pumps of swash plate construction are provided with displacement pistons which are guided in cylinders and rotate about the shaft of the variable displacement pump. During the rotation, the displacement pistons are supported on the swash plate. With each 360° rotation, each displacement piston executes a complete stroke.

The swash plate, which may be designed as an adjustable-angle plate or as a rocker device, forms a planar running surface for the displacement pistons. The swash plate is referred to as a rocker device if it is mounted in cylinder shells on rolling-contact elements and is pressed into the cylinder shells by means of suitable holding-down devices. The swash plate is referred to as an adjustable-angle plate if it can be pivoted about the bearing journals.

Machine elements mounted in rolling-contact bearings, e.g. shafts, are usually introduced axially, by way of their bearings, into the bearing seats in their respective housings. This presupposes that the largest diameter of the machine element which is to be mounted is smaller than the largest bearing seat in the housing, in order for it to be possible for the machine element to be installed axially by way of this bearing seat.

If the largest diameter, located between the bearings, of the machine element which is to be mounted is larger than the distance between the bearing seats in the housing, the machine element cannot be installed by way of the bearing seat. In transmission construction, the transmission housing is split in order for it to be possible to ensure appropriate installation. A split transmission housing, however, has a number of disadvantages, these residing, in particular, in a reduction in the structural rigidity and increased outlay in terms of sealing.

Swash plates of hydrostatic pumps often have a maximum dimension which is larger than the distance between the bearing seats. In such cases, it is necessary to provide in the pump housing an opening which is large enough for axial installation and in which, once the swash plate has been introduced into the housing, a type of housing cover is then fastened. The external diameter of the housing cover here is larger than the largest swash plate diameter located between is the bearings. This cover fits with its external diameter into the housing bore and then accommodates the one bearing of the adjustable-angle plate in its internal diameter. The housing of the variable displacement pump thus has to be of relatively large configuration or the rigidity of the housing is reduced by the large opening. In some existing variable displacement pumps, in order to install a swash plate around a shaft in the housing, it is necessary to have a large opening which can be closed off by means of a cover.

In yet another known hydrostatic variable displacement pump, the outer bearing races are inserted in bores of the adjustable-angle plate, the structural unit comprising adjustable-angle plate and outer bearing races being introduced into the pump housing through a sufficiently large opening at any desired location. Journals with the inner bearing constituent parts plugged thereon are then introduced laterally into the housing. These journals engage in the outer bearing races on the adjustable-angle plate. The journals are connected to the housing, with the result that the adjustable-angle plate is mounted in the pump housing such that it can be rotated about the journals. This requires a very high degree of accuracy in production. The cover, on which there is fitted a journal for accommodating a bearing, has to be fastened on the housing rather than being an integrated constituent part thereof.

If the largest diameter of the swash plate is larger than the largest bearing seat in the housing during installation there is increased outlay in terms of components in the form of housing covers or additional journal structures. They are more expensive to produce overall, which results in the accuracy having to meet more stringent requirements, and which have an adverse effect on the structural rigidity of the housing.

Also, when the adjustable-angle plate is installed axially, i.e. in the direction of the shaft of the variable displacement pump, the rolling-contact bearings are pushed into the bearing seats. The bearing seats correspond approximately to half-shells. These half-shells, in most cases, give a wrap angle around the outer bearing race of not more than 180°, because the outer bearing races can be positioned relatively easily in the bearing seat. If the bearings are pressed in radially by axial introduction into the bearing seat, it is also possible for the wrap angle to be just over 180°. A wrap angle of considerably less than 360°, however, is associated with the problem of it being possible for the bearing-supporting capacity to be reduced, and for the radial and axial fixing of the bearings often requiring additional design outlay. This is because, when the wrap angle in the bearing seat is smaller than 180° or is only just over 180°, loading necessitates hold-down means in order to ensure reliable seating of the adjustable-angle plate in the bearing.

Therefore, a principal object of this invention is to provide a variable displacement pump by means of which an adjustable-angle plate of which the largest diameter or largest dimension is larger than the largest distance between its bearings can be installed in a compact non-split housing and can be mounted in commercially available 360° bearings.

These and other objects will be apparent to those skilled in the art.

SUMMARY OF THE INVENTION

The invention provides a hydrostatic variable displacement pump of swash plate construction which has a cylinder block, arranged in a housing, with displacement pistons guided therein, a swash plate and at least a first bearing and a second bearing, which supports the swash plate in respect of bearing seats in the housing. The swash plate can have its angle position adjusted in relation to the movement direction of the displacement pistons by means of a servosystem. The largest dimension of the swash plate is larger than the distance between the bearing seats of the first bearing and of the second bearing. The housing has a first opening and a second opening, with the swash plate being introduced into the housing through the first opening. The second opening may be closed off by means of a cover, in which the servosystem for the angle adjustment of the swash plate is preferably integrated. The first bearing has a removable outer race which is designed such that, following installation of the swash plate in the bearing seat of the second bearing, it fixes the swash plate in the associated bearing seat of the first bearing.

This invention does away with the need for an additional cover, on which journals are fitted as a bearing seat, with the result that the two bearings for the swash plate are provided in the housing itself, which is designed as a non-split housing. It is thus possible for the production of the housing including the bearing seats to take place in one clamping setting, which is not only more straightforward in production terms, but considerably increases the production accuracy, in particular, of the two bearing seats in relation to one another. Since use can be made of a non-split housing, additional sealing problems with a cover which is to be provided in addition do not arise. Moreover, in terms of structural rigidity, a non-split housing has the advantage over a split housing with respect to the high hydraulic pressures occurring in the case of such variable displacement pumps. The possibility of using bearing seats with a wrap angle of considerably more than 180° around the outer race of the bearing makes it possible to use adjustable-angle plates without hold-down devices. It is also possible for the hydrostatic variable displacement pump to be used with hold-down devices. By virtue of the bearing seats being fitted in a non-split housing, bearing failure and alignment errors between the bearing seats are thus reduced, if not avoided altogether. Overall, the variable displacement pump makes it possible to use a very compact housing and to reduce the number of necessary components.

According to one embodiment of the invention, the swash plate is designed as an adjustable-angle plate which has a servoarm which is preferably provided with an angled lever. This servoarm extends, beyond the external diameter of the bearing seat of the first bearing, into the servosystem, which closes off the opening in the housing, on which the first bearing is arranged. By virtue of the servoarm, which has the bearing projecting through it and is enclosed by the cover, the compactness of the variable displacement pump is further increased. On the other hand, the full structural rigidity of the subassembly is ensured.

The servoarm with its angled lever is preferably dimensioned and/or arranged such that the movement axis of the servopiston of the servosystem runs through the servoarm. This realizes relatively straightforward force transmission from the servopiston to the adjustable-angle plate without it being necessary to provide additional force-transmission devices.

The second bearing has a bearing seat which supports the second bearing over a circumferential region which is preferably considerably greater than 180°. As a result, during installation, the second bearing has to be introduced radially (transversely to the pump shaft) into the bearing seat. That is, installation of the bearing in the bearing seat in the axial direction (in the direction of the longitudinal axis of the pump shaft) is not possible. As a result, however, the supporting capacity of the bearing seat is considerably increased.

The swash plate is designed as a rocker device which is pushed into the bearings by means of a holding-down device. Using a rocker device as the swash plate exploits the advantages of a compact swash plate construction, consisting of a high level of possible bearing loading by the use of a bearing seat, located in an inner housing, of greater than 180°. Also use of commercially available rolling-contact bearings is possible. Such bearings are those which can absorb axial and radial forces, i.e. preferably tapered roller bearings.

The swash plate is formed in one piece. This reduces the number of components of the subassembly and also increases the structural strength of the swash plate, which is likewise subjected to high loading.

DESCRIPTION OF THE EMBODIMENT(S) OF THE INVENTION

Figure 1:
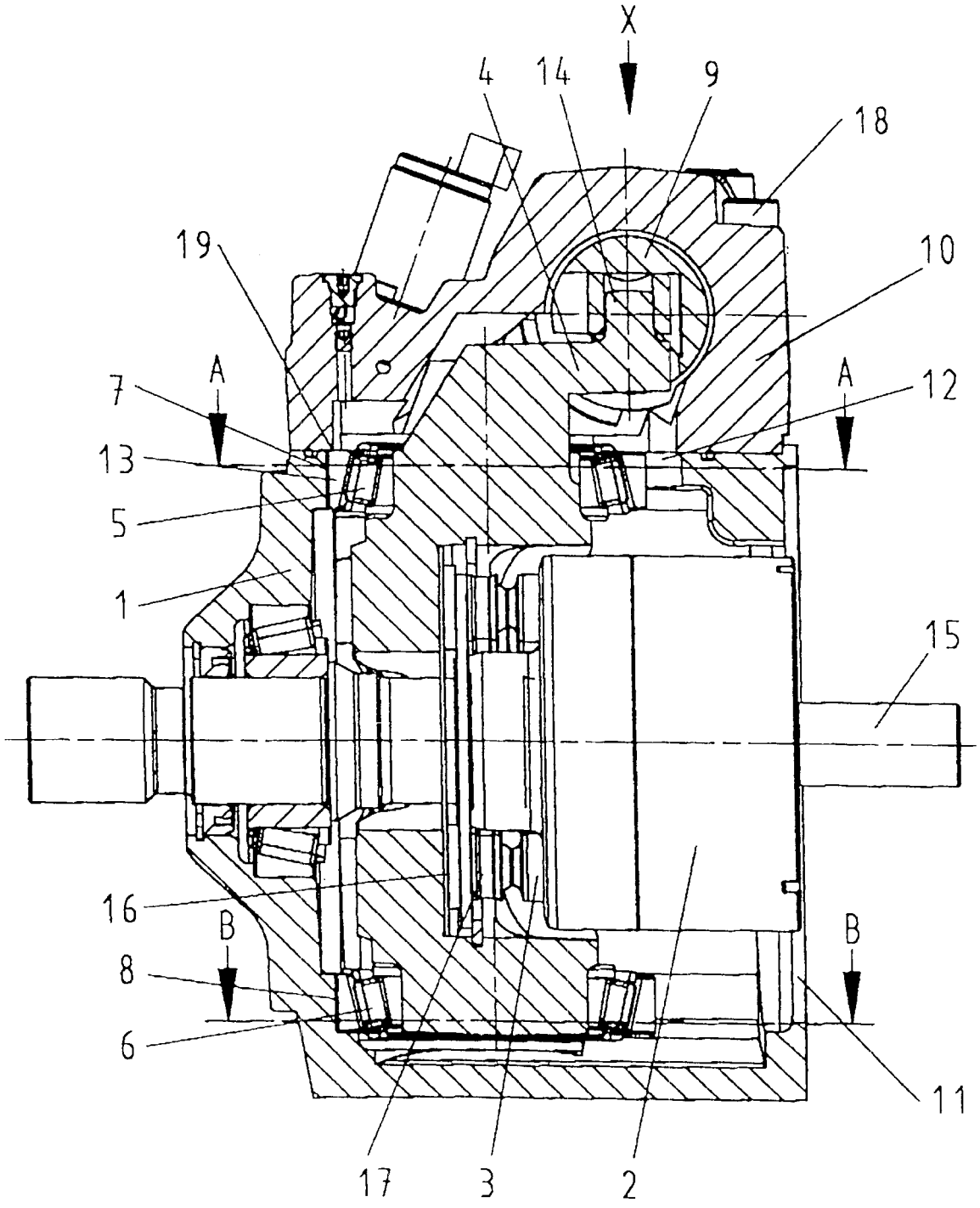
FIG. 1 is an axial-section view of the hydrostatic variable displacement pump according to the invention with an adjustable-angle plate.

FIG. 1 shows an axial-section view of a hydrostatic variable displacement pump with adjustable-angle-plate mounting. The variable displacement pump has a housing 1 in which there is arranged a cylinder block 2, which has displacement pistons 3 which are arranged parallel to the axis of rotation of the shaft 15 and are guided in cylinders. Also arranged in the housing 1 is an adjustable-angle plate 4, which is mounted in the housing by means of the bearings 5, 6 such that it can be pivoted about an axis in a direction perpendicular to the axis of rotation of the cylinder block 2. That side of the adjustable-angle plate 4 which is directed toward the displacement pistons 3 has a sliding-block-supporting surface 16, and the respective sliding block 17 for accommodating the individual displacement pistons 3, butts against said supporting surface. Pivoting the adjustable-angle plate out of the neutral zero-degree position produces an inclined sliding-block-supporting surface, with the result that, upon circulation of the cylinder block 2 of the displacement pistons 3 through 360°, each displacement piston executes a complete stroke corresponding to the deflecting-angle position of the adjustable-angle plate 4.

The housing 1 has a first opening 11, which is axial relation to the axis of rotation of the cylinder block 2, and a second, radial opening 12. The external diameter or the largest radial dimension of the adjustable-angle plate 4 is larger than the respective distance between the outsides of the bearings 5, 6. As a result, a servoarm 14 with an angled lever projects outward through the bearing 5 and the second opening 12. A servo-adjustment piston 9, which serves for the angle adjustment of the adjustable-angle plate 4, acts on the servoarm 14 or on the angled lever thereof. The servo-adjustment piston 9 is part of a servomechanism which is integrated in a cover 10, which covers the second opening 12 of the housing 1 such that the housing is closed off and the servoarm is accommodated such that the servo-adjustment piston 9 can bring about an angle adjustment of the adjustable-angle plate 4. The cover 10 is fixed to the housing by means of screws 18.

The shapes of the adjustable-angle plate 4 and of the housing 1 of the variable displacement pump are coordinated with one another such that the installation group comprising the adjustable-angle plate 4 and bearings 5, 6 can be introduced through the large first opening 11 of the housing 1. The installation group is introduced, then, such that it can be positioned between the two bearing seats 7, 8 in the housing 1. In this case, the installation group is first of all moved upward as far as possible through the second opening 12 in the radial direction according to FIG. 1. This is possible because the bearing 5 is designed as a split bearing with removable outer race 13. As a result, the bearing 6 of the adjustable-angle plate is positioned in the housing 1 such that it can be inserted into the bearing seat 8 provided for this purpose. As a result of the not yet inserted removable outer race 13, the adjustable-angle plate is not yet fully fixed in the axial direction in the region of the bearing 5. Once the bearing 6 has been fully inserted into the bearing seat 8 provided in the housing, the removable outer race 13 is inserted on the bearing 5 on the bearing seat 7.

Insertion of the removable outer race 13 of the bearing fixes the adjustable-angle plate 4 fully in position in the housing. The possibility of introducing the installation group into the housing 1 of the variable displacement pump through the first opening 11 does away with the need to provide a further opening on the side of the housing 1 of the variable displacement pump which is at the bottom according to FIG. 1. The cover which has to be provided for this would have to form the bearing seat for the bearing 6. According to the invention, however, this bearing seat is arranged directly in the housing, as a result of which alignment errors of the two bearings 5, 6 in relation to one another can be avoided to the greatest possible extent since the housing can be processed with the bearing seats in one clamping setting.

The bearing seat 8 is designed in the form of a bearing shoulder in the housing 1 and encloses the bearing 6 circumferentially over an angle of less than 360°, a full 360° seat also being possible. A bearing seat which extends considerably over 180° of the circumference increases the bearing forces which can be absorbed by the bearing seat and thus, ultimately, also the service life of the variable displacement pump as a whole.

The bearings 5, 6 are designed as tapered roller bearings of conventional construction, with the result that both axial and radial bearing forces can be absorbed. The removable outer race 13 of the bearing 5 is supported on the bearing seat 7 and, following installation of the cover 10 with integrated servomechanism, is fixed by a shoulder 19, formed in the cover, in the radial direction in relation to the axis of rotation of the cylinder block 2. It is possible here for the retaining shoulder 19 to be designed such that the removable outer race 13 imparts prestressing to the tapered roller bearing 5.

The servo-adjustment piston 9 and the angled lever of the servoarm 14 are arranged in relation to one another such that the movement axis of the servo-adjustment piston of the servomechanism 9, 10 runs through the angled lever, this resulting in the adjustment force exerted by the servo-adjustment piston 9 being introduced directly into the adjustable-angle plate 4 in order to change the angle position and thus the effective stroke of the displacement pistons 3.

Figure 2:
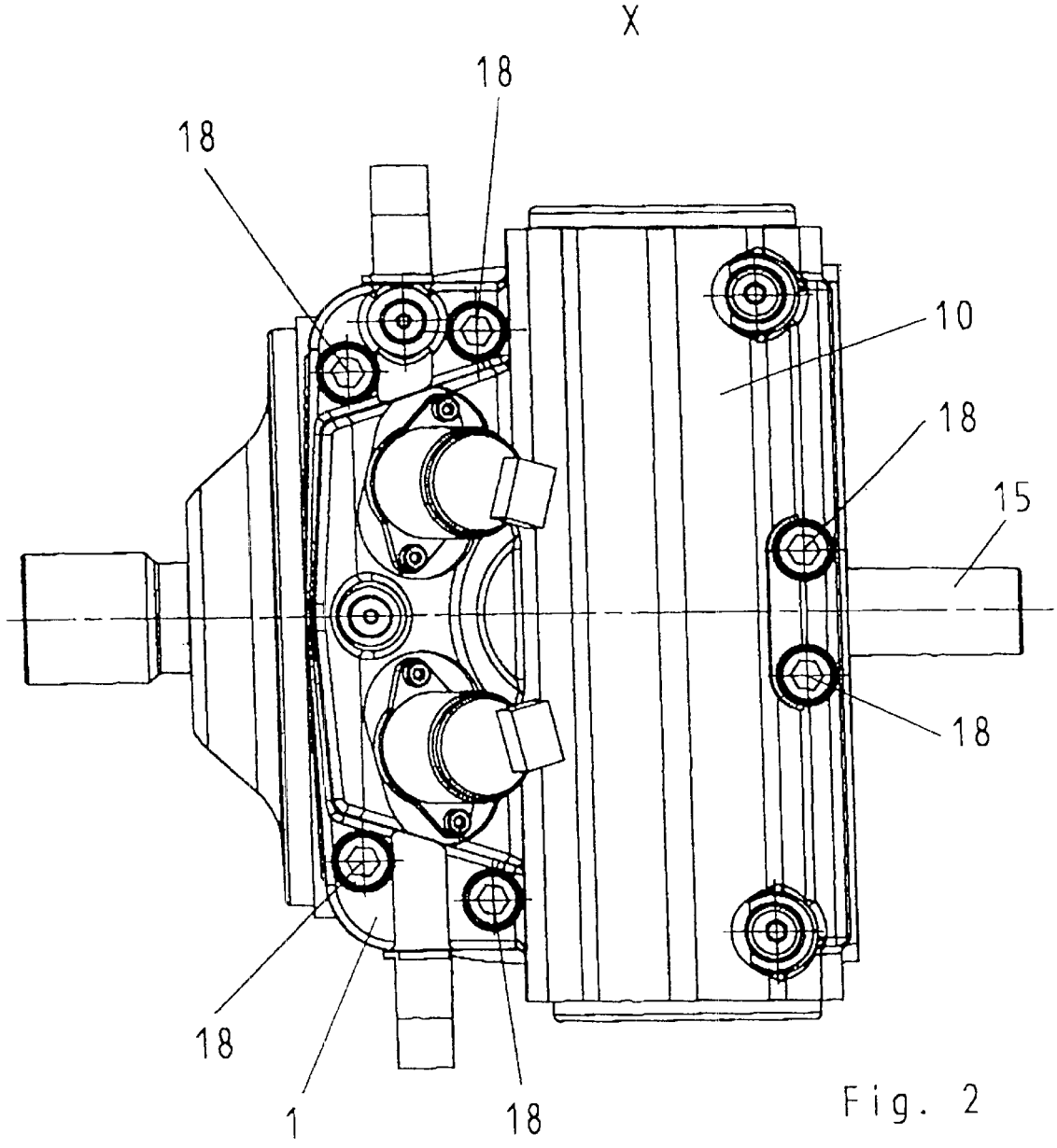
FIG. 2 is a plan view in direction X of the housing closed off by the servosystem integrated in the cover.

FIG. 2 illustrates a plan view in direction X, according to FIG. 1, of the variable displacement pump. The cover 10, which closes off the second opening 12 to the full extent, with integrated servomechanism is fixed to the housing by means of screws 18. The shaft 15, which supports the cylinder block 2 (not illustrated), projects through the housing 1 of the variable displacement pump in the axial direction on both sides.

Figure 3:
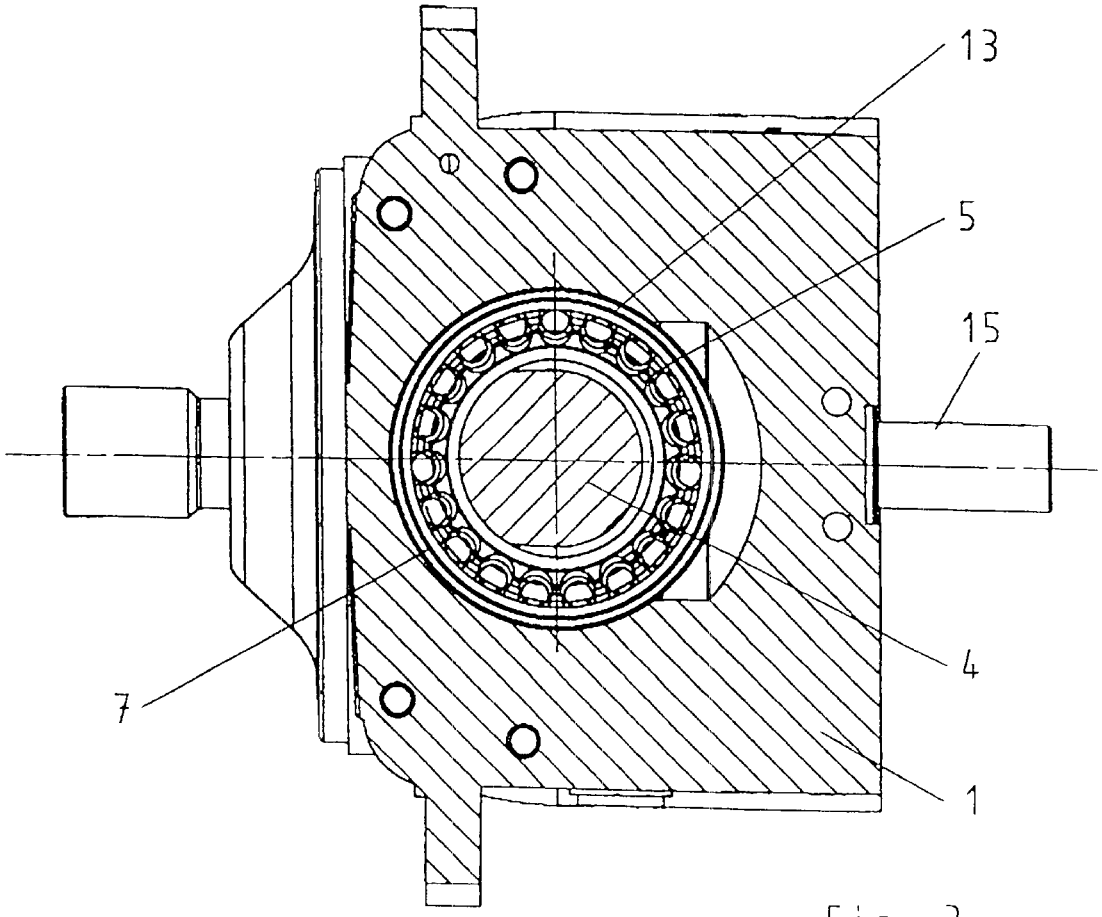
FIG. 3 is a view of section plane A—A according to FIG. 1.

FIG. 3 shows a sectional view through the plane A—A according to FIG. 1. The bearing 5 has the servoarm of the adjustable-angle plate 4 projecting through its inner race. The removable outer race 13 of the bearing 5 is accommodated in the bearing seat 7, which supports the outer race of the bearing, and thus the bearing 5, over approximately 270° of its circumference, and thus considerably more than 180°.

Figure 4:
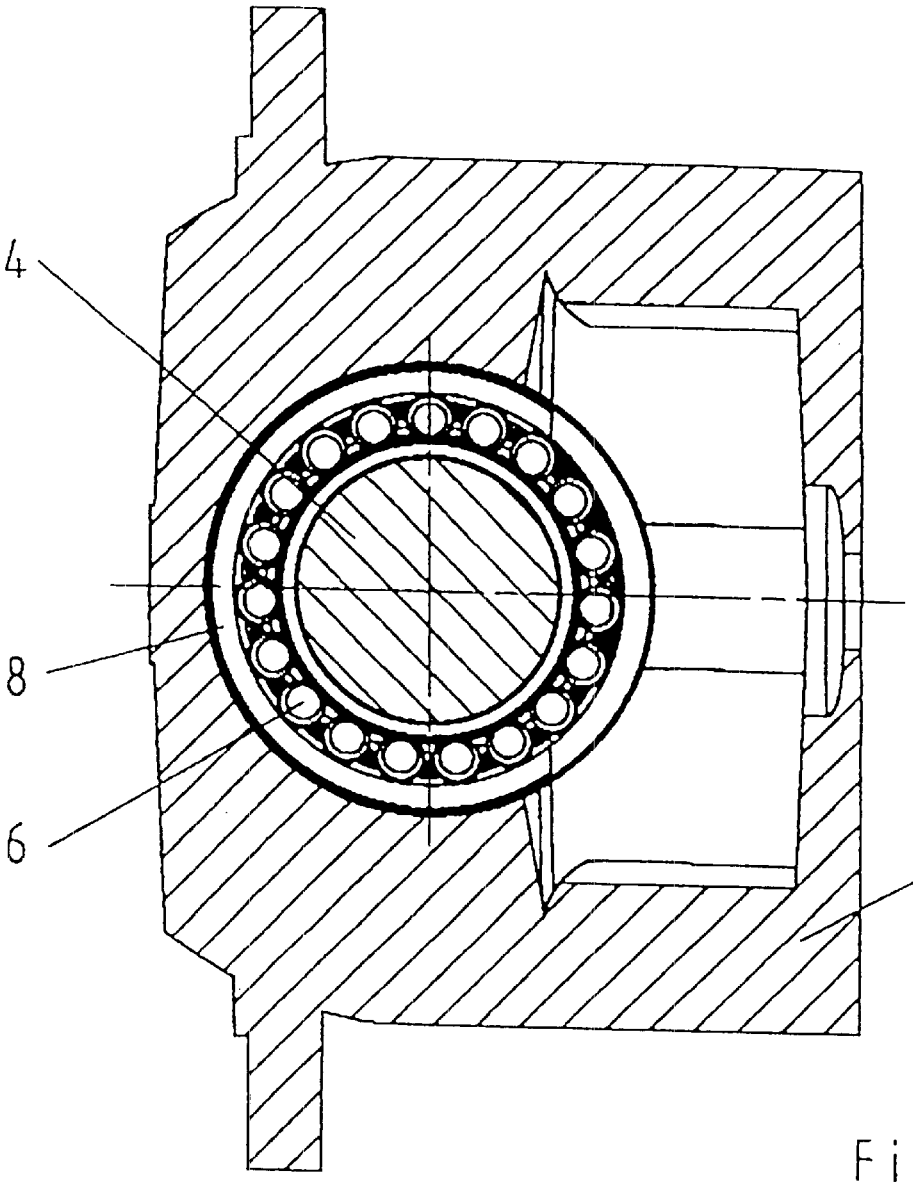
FIG. 4 shows a view of section plane B—B according to FIG. 1.

FIG. 4 shows a sectional view along plane B according to FIG. 1, through the bearing region of the bearing 6. The bearing 6 is installed firmly, by way of its inner race, on that end of the adjustable-angle plate 4 which is designed in the form of a journal, the installation group, with bearing 6 in its entirety, being inserted into the bearing seat 8 in the housing 1 once the installation group has been introduced through the first opening 11 in the housing 1 (see FIG. 1). Here too, the bearing seat 8 is designed for accommodating the bearing 6 over considerably more than 180° of its circumference.

Figure 5:
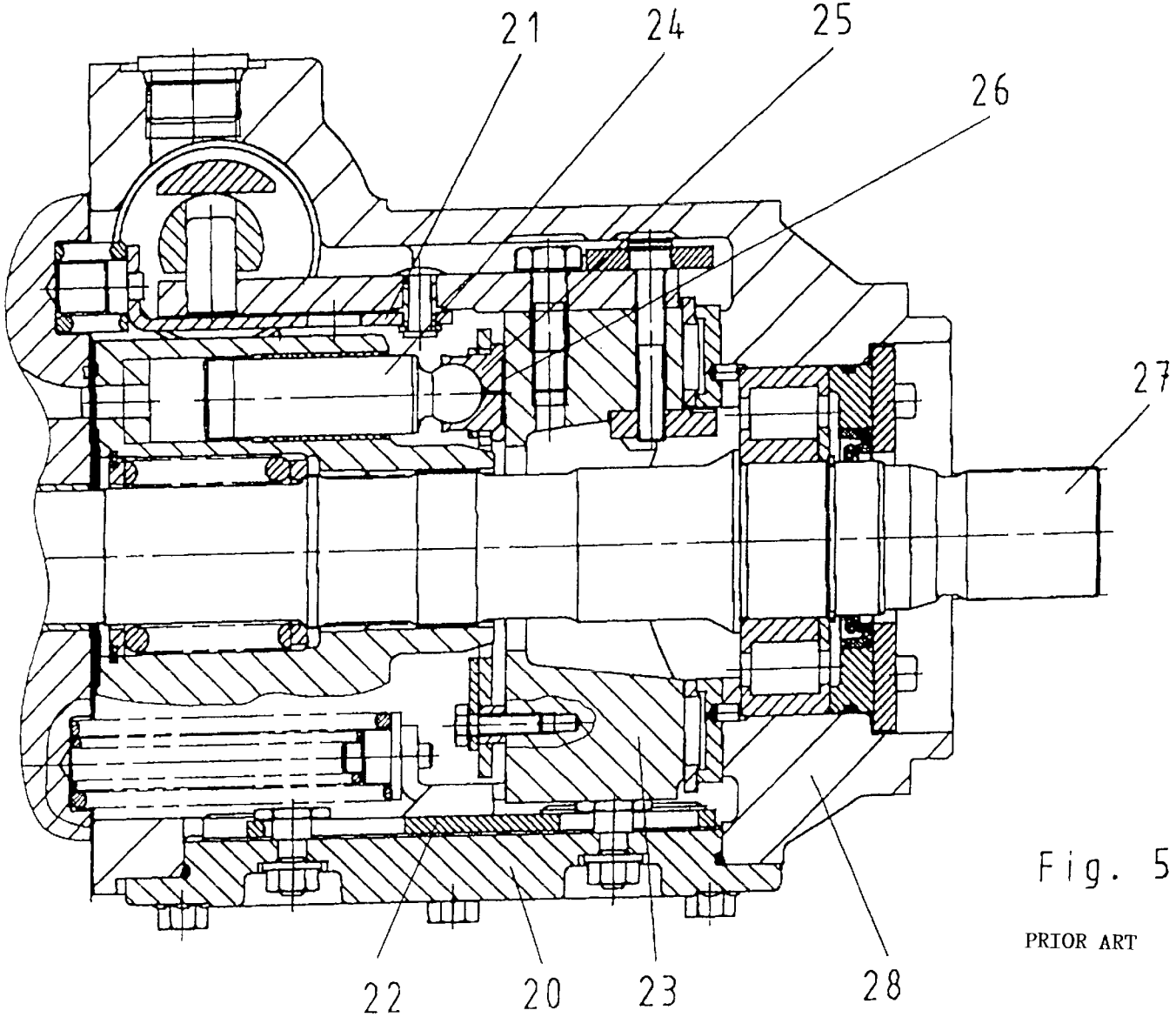
Fig. 5 PRIOR ART
FIG. 5 shows an axial-section view of a known variable displacement pump (BR90).

FIG. 5, illustrates a design according to the prior art, the illustrated variable displacement pump with its known adjustable-angle-plate mounting constituting a model from the applicants series (BR90). The cylinder block with the displacement pistons 24 is arranged on the shaft 27, which passes through the housing 28, and the displacement pistons 24 are supported on the sliding-block-running surface 26 of the swash plate 23 by way of their respective sliding blocks,25. An additional cover 20 is provided for installation purposes, it being possible for the swash plate 23 to be installed in the housing 28 by way of said cover. In order to ensure permanent seating in the bearings of the swash plate 23, holding-down devices 21, 22 are provided.

From the foregoing, it is seen that this invention will accomplish at least all of its stated objectives.

List of parts

1 Housing
2 Cylinder block
3 Displacement piston
4 Adjustable-angle plate
5 First bearing
6 Second bearing
7 First bearing seat
8 Second bearing seat
9 Servo-adjustment piston
10 Cover with integrated servomechanism
11 First opening
12 Second opening
13 Removable outer race
14 Servoarm with angled lever
15 Shaft
16 Sliding-block-supporting surface
17 Sliding block
18 Screw
19 Retaining shoulder
20 Additional cover for installation purposes
21,22 Holding-down device
23 Swash plate
24 Displacement piston
25 Sliding block
26 Sliding-block-supporting surface
27 Shaft
28 Housing

We claim:

1. A hydrostatic variable displacement pump of swash plate construction, comprising:

a cylinder block (2), arranged in a housing (1), with displacement pistons (3) guided therein;

a swash plate (4) and at least a first bearing (5) and a second bearing (6), which support the swash plate (4);

the bearings having respective bearing seats (7,8) arranged in the housing (1);

the swash plate (4) having its angle position adjustable in relation to the movement direction of the displacement pistons (3) by means of a servomechanism (9,10);

the housing (1) has at least a first opening (11), through which the swash plate (4) can be introduced into the housing (1) for installation purposes, and a second opening (12), for accommodation of at least a portion of the servomechanism (9,10), which is located in the housing (1), and is connected to the swash plate (4) for the adjustment of the latter;

the first bearing (5) having a removable outer race (13) which fixes the swash plate (4) in the bearing seat (7) of the first bearing (5), following installation of the second bearing (6) of the swash plate (4) in the bearing seat (8) of the second bearing;

the servo-mechanism (9, 10) is integrated in a cover (10) which closes off the housing (1) on the side of the first bearing (5).

2. The hydrostatic variable displacement pump of claim 1 wherein, the swash plate (4) is an adjustable-angle plate with a servoarm which extends through the first bearing (5) into the servosystem (9, 10); the largest dimension of the adjustable-angle plate (4) being larger than the distance between the bearing seats (7, 8) of the first bearing (5) and of the second bearing (6).

3. The hydrostatic variable displacement pump of claim 2 wherein the movement axis of the servo-adjustment piston (9) of the servomechanism (9, 10) runs through the servoarm (14).

4. The hydrostatic variable displacement pump of claim 2 wherein the second bearing (6) has a bearing seat (8) which supports the second bearing (6) over a circumferential region >180°.

5. The hydrostatic variable displacement pump of claim 3 wherein the second bearing (6) has a bearing seat (8) which supports the second bearing (6) over a circumferential region >180°.

6. The hydrostatic variable displacement pump of claim 1 wherein the swash plate (4) is a rocker which is pushed into the bearings (5, 6) by means of a holding-down device.

7. The hydrostatic variable displacement pump of claim 6 wherein at least the bearing seat (8) of the second bearing (6) supports the latter over a circumferential region <180°.

8. The hydrostatic variable displacement pump of claim 1 wherein the bearings (5, 6) are designed for absorbing axial and radial forces.

9. The hydrostatic variable displacement pump claimed in claim 1 in which the swash plate (4) is formed in one piece.

* * * * *